US009316236B2

(12) United States Patent
Kondo et al.

(10) Patent No.: US 9,316,236 B2
(45) Date of Patent: Apr. 19, 2016

(54) HYDRAULIC DRIVING APPARATUS FOR WORKING MACHINE

(71) Applicants: Kobelco Cranes Co., Ltd., Shinagawa-ku (JP); Kobe Steel, Ltd., Kobe-shi (JP)

(72) Inventors: Hiroo Kondo, Hyogo (JP); Takaharu Michida, Hyogo (JP); Katsuki Yamagata, Hyogo (JP); Naoto Hori, Hyogo (JP); Naoya Kitazumi, Hyogo (JP); Satoshi Maekawa, Hyogo (JP); Naoki Sugano, Hyogo (JP)

(73) Assignees: KOBELCO CRANES CO., LTD., Shinagawa-ku (JP); Kobe Steel, Ltd., Kobe-shi (JP)

( * ) Notice: Subject to any disclaimer, the term of this patent is extended or adjusted under 35 U.S.C. 154(b) by 532 days.

(21) Appl. No.: 13/713,680

(22) Filed: Dec. 13, 2012

(65) Prior Publication Data

US 2013/0152575 A1 Jun. 20, 2013

(30) Foreign Application Priority Data

Dec. 16, 2011 (JP) ..... 2011-275726

(51) Int. Cl.
*F15B 11/04* (2006.01)
*F15B 9/08* (2006.01)
(Continued)

(52) U.S. Cl.
CPC ..... *F15B 9/08* (2013.01); *F15B 11/044* (2013.01); *F15B 21/047* (2013.01);
(Continued)

(58) Field of Classification Search
CPC ..... F15B 11/044; F15B 11/0445; F15B 2211/253; F15B 2211/46; F15B 9/08; F15B 21/047
See application file for complete search history.

(56) References Cited

U.S. PATENT DOCUMENTS 5,537,819 A 7/1996 Kobayashi
5,571,226 A 11/1996 Kobayashi
(Continued)

FOREIGN PATENT DOCUMENTS

CN 1109950 A 10/1995
CN 1113092 A 12/1995
(Continued)

OTHER PUBLICATIONS

Office Action issued Oct. 15, 2013 in German Application No. 10 2012 223 225.7 (With English Translation).
(Continued)

*Primary Examiner* — Nathaniel Wiehe
*Assistant Examiner* — Abiy Teka
(74) *Attorney, Agent, or Firm* — Oblon, McClelland, Maier & Neustadt, L.L.P.

(57) ABSTRACT

Provided is a hydraulic driving apparatus for a working machine, preventing an excessive decrease in pressure on a meter-in side and moving a load at a stable speed in a lowering direction. The apparatus comprises: a hydraulic pump; a hydraulic actuator; a manipulation device; a working hydraulic circuit including a meter-in flow passage and a meter-out flow passage; a control valve for changing a state of supply of hydraulic fluid to drive the hydraulic actuator at a speed designated by the manipulation device; a meter-in flow adjuster and a meter-out flow adjuster adapted to adjust a meter-in flow rate and meter-in flow rate respectively to respective value corresponding to the speed designated by the manipulation device; and a relief valve. The meter-in and meter-out flow adjusters have respective flow adjustment characteristics such that the meter-in flow rate is greater than the meter-out flow rate.

6 Claims, 5 Drawing Sheets

(51) Int. Cl.
*F15B 11/044* (2006.01)
*F15B 21/04* (2006.01)

(52) U.S. Cl.
CPC *F15B 2211/3116* (2013.01); *F15B 2211/3157* (2013.01); *F15B 2211/329* (2013.01); *F15B 2211/353* (2013.01); *F15B 2211/46* (2013.01); *F15B 2211/7058* (2013.01); *F15B 2211/75* (2013.01); *F15B 2211/761* (2013.01); *F15B 2211/8609* (2013.01)

(56) References Cited

U.S. PATENT DOCUMENTS 5,884,984 A 3/1999 Arai et al.
6,112,521 A * 9/2000 Hayashi et al. ..... 60/460
2009/0308068 A1 12/2009 Yoshino
2012/0285152 A1 11/2012 Sugano et al.
2012/0285159 A1 11/2012 Sugano et al.

FOREIGN PATENT DOCUMENTS

CN 1174596 A 2/1998
CN 1914384 A 2/2007
DE 199 13 277 B4 11/2007
JP 3-255204 A 11/1991
JP 2000255988 A * 9/2000
JP 2000-310201 11/2000

OTHER PUBLICATIONS

Combined Chinese Office Action and Search Report issued Nov. 24, 2014, in Patent Application No. 201210544104.X (with English-language summary).

* cited by examiner

HYDRAULIC DRIVING APPARATUS FOR WORKING MACHINE

BACKGROUND OF THE INVENTION

1. Field of the Invention

The present invention relates to a hydraulic driving apparatus provided in a working machine, such as a crane, to move a load, such as a suspended load, in the same direction as a self-weight falling direction of the load.

2. Description of the Background Art

As a hydraulic driving apparatus for moving a load in the same direction as a self-weight falling direction of the load, there is known, for example, a lowering drive apparatus for driving a winch suspending a suspended load by a wire rope, in a lowering direction. In this apparatus, it is important to prevent that an excessive decrease in pressure on a meter-in side during a lowering drive causes cavitation which stalls winch driving to thereby bring the suspended load into free falling.

As means to prevent such a decrease in pressure on the meter-in side, JP 2000-310201A describes a so-called external pilot-operated counterbalance valve provided in a flow passage on a meter-out side. The external pilot-operated counterbalance valve is operable to narrow the flow passage on the meter-out side when the pressure on the meter-in side becomes equal to or less than a setting pressure thereof, thereby preventing the pressure on the meter-in side from an excessive decrease.

The external pilot-operated counterbalance valve, however, has a pressure measurement point on the meter-in side while having a pressure control point thereof on the meter-out side; that is, the external pilot-operated counterbalance valve is configured to perform control under the condition that positions of measurement and control points are different from each other, i.e., perform control out of so-called control-theoretic co-location, thus having a problem that the performed control is fundamentally unstable and likely to involve hunting.

As means to prevent the above hunting, there exists a technique of providing an orifice capable of giving large attenuation to an opening movement of the counterbalance valve, in a pilot fluid passage; however, this technique has a problem that the orifice prolongs a valve opening time of the counterbalance valve to deteriorate the responsiveness of the counterbalance valve, and further provides the counterbalance valve with a large flow resistance until it is fully opened to thereby generate an unnecessary boosted pressure.

As another technique for preventing the hunting, the JP 2000-310201A describes a communication valve for controlling fluid communication between the flow passage on the meter-in side and the flow passage on the meter-out side, and a flow adjustment valve for controlling a meter-in flow rate to reduce a pressure difference between the two flow passages; however, this technique has difficulty in obtaining a stable lowering speed. In a lowering control circuit, generally, there is generated a holding pressure corresponding to a weight of a suspended load on a meter-out side, so that, the larger the weight of the suspended load, the larger the pressure difference between meter-out and meter-in sides becomes, and the increase in the pressure difference involves an increase in an opening degree of the flow adjustment valve, thus increasing the meter-in flow rate. Hence, the above conventional apparatus has a possibility of large variation in the lowering speed depending on a level of the load.

SUMMARY OF THE INVENTION

It is an object of the present invention to provide a hydraulic driving apparatus for a working machine, the apparatus being capable of preventing pressure on a meter-in side from an excessive decrease and moving a load at a stable speed in a lowering direction, which is the same direction as a self-weight falling direction of the load, with no occurrence of hunting and large boosted pressure, which are disadvantage of the conventional counterbalance valve. The hydraulic driving apparatus comprises: a hydraulic pump for discharging hydraulic fluid; a hydraulic actuator having a first port and a second port and being adapted to be driven, by receiving a supply of hydraulic fluid discharged from the hydraulic pump through the first port and discharging the hydraulic fluid from the second port, so as to move the load in the lowering direction; a manipulation device manipulated to designate an operating speed of the hydraulic actuator; a working hydraulic circuit including a meter-in flow passage for introducing hydraulic fluid from the hydraulic pump into the first port of the hydraulic actuator when the hydraulic actuator is driven to move the load in the lowering direction and a meter-out flow passage for introducing hydraulic fluid discharged from the second port of the hydraulic actuator into a tank when the hydraulic actuator is driven to move the load in the lowering direction; a control valve for changing a state of the supply of hydraulic fluid from the hydraulic pump to the hydraulic actuator so as to operate the hydraulic actuator at the speed designated by the manipulation device; a meter-in flow adjuster for adjusting a meter-in flow rate, which is a flow rate of the hydraulic fluid in the meter-in flow passage, to a flow rate corresponding to the speed designated by the manipulation device; a meter-out flow adjuster for adjusting a meter-out flow rate, which is a flow rate of the hydraulic fluid in the meter-out flow passage, to a flow rate corresponding to the speed designated by the manipulation device; and a relief valve adapted to be opened, when a pressure of the meter-in flow passage becomes equal to or greater than a setting pressure, so as to introduce hydraulic fluid flowing through the meter-in flow passage into the tank to thereby define an upper limit of the pressure of the meter-in flow passage. Furthermore, the meter-in flow adjuster and the meter-out flow adjuster have respective flow adjustment characteristics, each of which is a characteristic indicative of a relationship between the speed designated by the manipulation device and a flow rate to be adjusted according to the designated speed, such that the meter-in flow rate adjusted by the meter-in flow adjuster according to any value of the speed designated by the manipulation device is greater than a meter-out flow rate adjusted by the meter-out flow adjuster.

DESCRIPTION OF THE PREFERRED EMBODIMENTS

Figure 1:
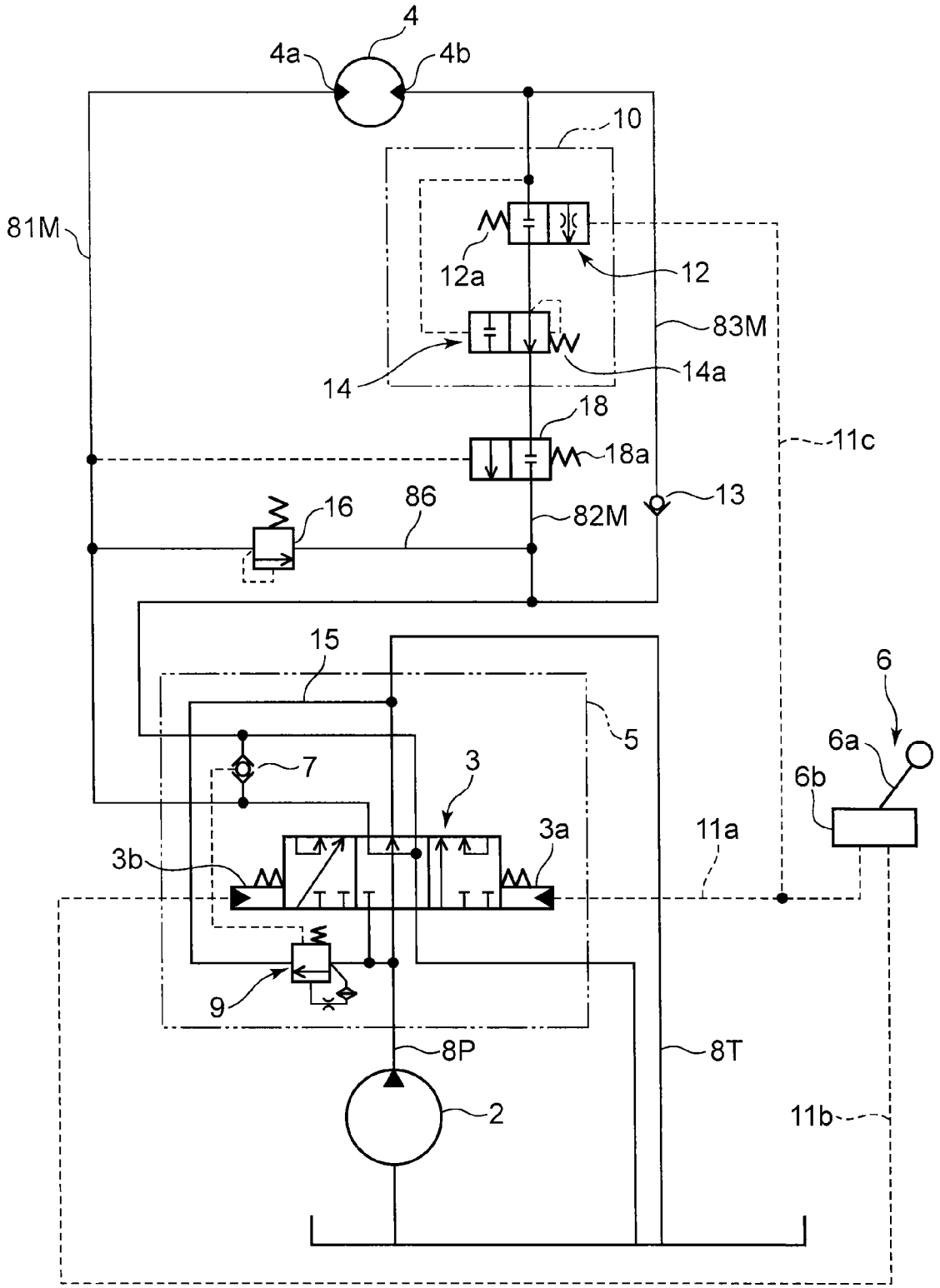
FIG. 1 is a circuit diagram showing a hydraulic driving apparatus for a working machine, the apparatus according to a first embodiment of the present invention.
Figure 2:
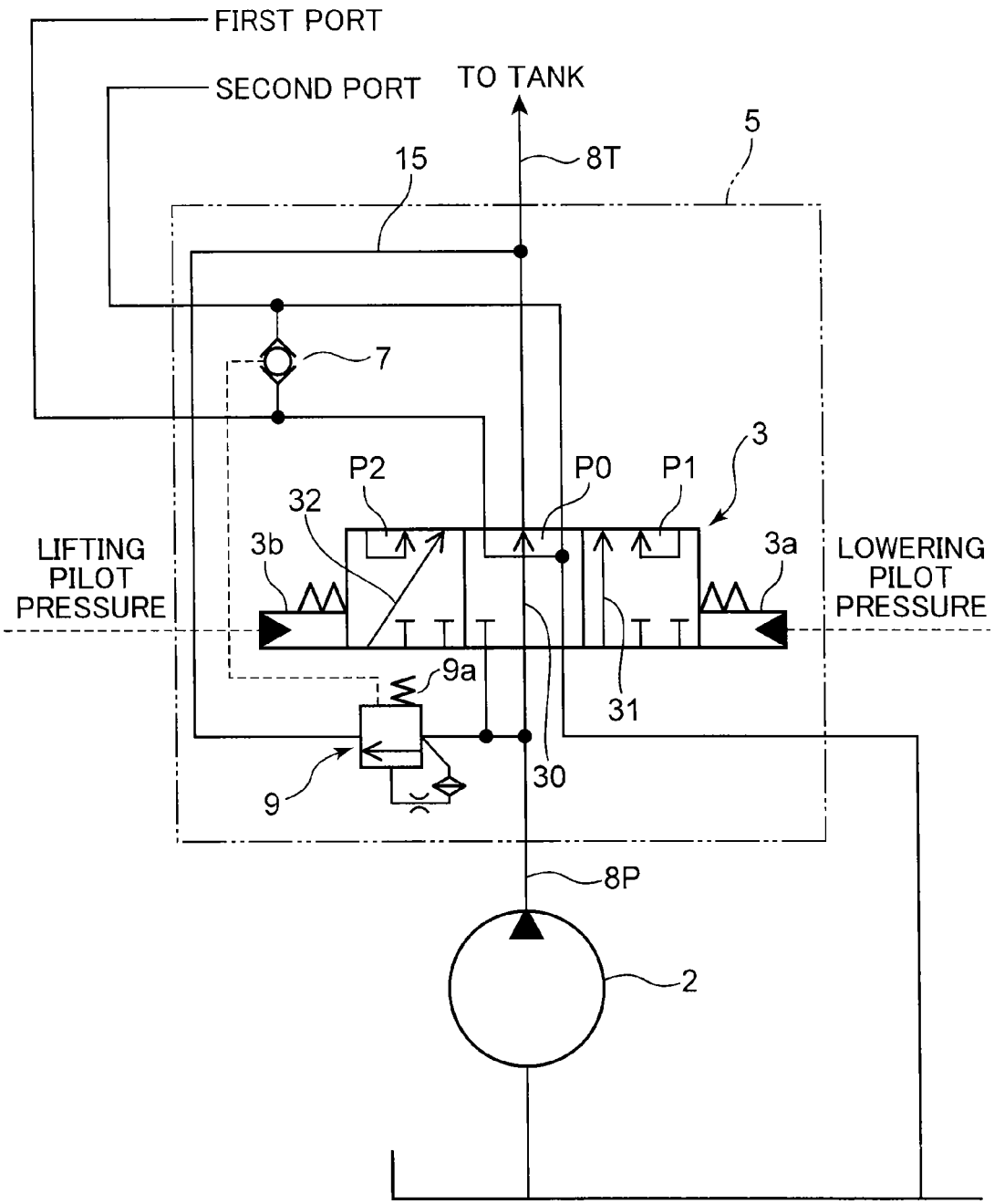
FIG. 2 is a circuit diagram enlargedly showing a control valve of the apparatus shown in FIG. 1.

There will be described a first embodiment of the present invention with reference to FIGS. 1 to 3. FIG. 1 is a circuit diagram showing an overall configuration of a hydraulic working apparatus according to the first embodiment, and FIG. 2 schematically shows a substantial part of the apparatus. The following description will be made primarily with reference to FIG. 1.

The apparatus shown in FIG. 1 comprises a hydraulic pump 2, a hydraulic motor 4, a working hydraulic circuit, a remote control valve 6 constituting a manipulation device, a control valve 5 capable of serving as a meter-in flow adjuster, a meter-out flow adjuster 10, a pilot-operated switch valve 18, and a relief valve 16.

The hydraulic pump 2 is adapted to be driven by a non-shown engine to suck hydraulic fluid in a tank and discharge it therefrom according to the driving.

The hydraulic motor 4, one example of the hydraulic actuator set forth in the appended claims, is incorporated in a winch unit having a winch drum not graphically shown, and is designed to rotate the winch drum in both forward and reverse directions to lift and lower a suspended load which is a load. Specifically, the hydraulic motor 4, having a first port 4*a* and a second port 4*b*, rotates the winch drum in a lowering direction, i.e., in a direction of lowering the suspended load, when hydraulic fluid is supplied to the first port 4*a*, while discharging the hydraulic fluid from the second port 4*b*, and rotates the winch drum in a lifting direction, i.e., in a direction of lifting the suspended load, when hydraulic fluid is supplied to the second port 4*b*, while discharging the hydraulic fluid from the first port 4*a*.

The working hydraulic circuit is to perform supply and drainage of hydraulic fluid (discharged from the hydraulic pump 2) with respect to the hydraulic motor 4. There are a plurality of pipelines to form the circuit: a pump hydraulic line 8P connecting a discharge port of the hydraulic pump 2 and the control valve 5; a first motor hydraulic line (first actuator hydraulic line) 81M connecting the control valve 5 to the first port 4*a* of the hydraulic motor 4; a second motor hydraulic line (second actuator hydraulic line) 82M connecting the control valve 5 to the second port 4*b* of the hydraulic motor 4, wherein the meter-out flow adjuster 10 and the switch valve 18 are provided in the second motor hydraulic line 82M; a third motor hydraulic line (third actuator hydraulic line) 83M arranged in parallel to the second motor hydraulic line 82M so as to bypass the meter-out flow adjuster 10 and the switch valve 18; and a relief hydraulic line 86 branched off from a midway point of the first motor hydraulic line 81T and joined to the second motor hydraulic line 82M.

The control valve 5 is interposed between the hydraulic pump 2 and the hydraulic motor 4 to change a mode of driving the hydraulic motor 4 between a lowering driving mode and a lifting driving mode, depending on a direction of manipulation (manipulation direction) of a manipulation lever 6*a* of the remote control valve 6, and change a state of the supply of hydraulic fluid from the hydraulic pump 2 to the hydraulic motor 4 so as to rotate the hydraulic motor 4 at a speed corresponding to an amount of the manipulation (manipulation amount). Particularly, the control valve 5 in this embodiment can additionally serve as a meter-in flow adjuster for adjusting a meter-in flow rate, which is a flow rate of the hydraulic fluid in a meter-in flow passage for supplying the hydraulic fluid from the hydraulic pump 2 to the first port 4*a* of the hydraulic motor 4, during the lowering driving.

Specifically, as shown in FIG. 2, the control valve 5 in this embodiment includes a direction control valve 3, a shuttle valve 7 and a meter-in flow adjustment valve 9.

The direction control valve 3 is a direction and flow rate control valve composed of a pilot-operated three-position selector valve with a lowering pilot port 3*a* and a lifting pilot port 3*b*. The direction control valve 3 is adapted to be held in a neutral position P0 when no pilot pressure is supplied to the two pilot ports 3*a*, 3*b*, while adapted to be opened, upon supply of a pilot pressure to the lowering pilot port 3*a*, in a direction from the neutral position P0 to a lowering driving position P1 by a stroke corresponding to the supplied pilot pressure and opened, upon supply of a pilot pressure to the lifting pilot port 3*b*, in a direction from the neutral position P0 to a lifting driving position P2 by a stroke corresponding to the supplied pilot pressure.

In each of the positions, the direction control valve 3 forms the following flow passage.

(i) In the neutral position P0, the direction control valve 3 hinders hydraulic fluid discharged from the hydraulic pump 2 from being supplied to the hydraulic motor 4, and forms a bleed-off flow passage for leading the hydraulic fluid directly to the tank through a tank hydraulic line 8T. In the neutral position P0, the direction control valve 3 has a bleed-off orifice 30 for setting a bleed-off flow rate, the bleed-off orifice 30 having a variable opening area which is reduced with distance from the neutral position P0.

(ii) In the lowering driving position P1, the direction control valve 3 connects the pump hydraulic line 8P to the first motor hydraulic line 81M to open up a flow passage for introducing hydraulic fluid discharged from the hydraulic pump 2 into the first port 4*a* of the hydraulic motor 4, namely, a "meter-in flow passage" for the lowering driving, while connecting the second motor hydraulic line 82M to the tank hydraulic line 8T to open up a flow passage for returning hydraulic fluid discharged from the second port 4*b* of the hydraulic motor 4 to the tank, namely, a "meter-out flow passage" for the lowering driving. In summary, the direction control valve 3 allows the first motor hydraulic line 81M to function as a hydraulic line forming the meter-in flow passage during the lowering driving mode and allows the second motor hydraulic line 82M to function as a hydraulic line forming the meter-out flow passage during the lowering driving mode. Besides, the direction control valve 3 connects the relief hydraulic line 86 to the tank hydraulic line 8T.

Furthermore, in the lowering driving position P1, the direction control valve 3 has a meter-in orifice 31 for setting a meter-in flow rate, which is a flow rate of hydraulic fluid in the meter-in flow passage during the lowering driving mode, and the meter-in orifice 31 has a variable opening area which is increased with stroke from the neutral position P0.

(iii) In the lifting driving position P2, the direction control valve 3 connects the pump hydraulic line 8P to the third motor hydraulic line 83M to form a flow passage for introducing hydraulic fluid discharged from the hydraulic pump 2 into the second port 4*b* of the hydraulic motor 4, and connects the first motor hydraulic line 81M to the tank hydraulic line 8T to form a flow passage for returning hydraulic fluid discharged from the first port 4*a* of the hydraulic motor 4 to the tank. In addition, also in the lifting driving position P2, the direction control valve 3 has a meter-in orifice 32 for setting a meter-in flow rate, which is a flow rate of hydraulic fluid in the meter-in flow passage during the lifting driving mode, and the meter-in orifice 32 has a variable opening area which is increased with stroke from the neutral position P0.

The shuttle valve 7, which is connected to the first motor hydraulic line 81M and the third motor hydraulic line 83M, selects a higher one of respective pressures in the two hydraulic lines and input the selected pressure to the meter-in flow adjustment valve 9.

The control valve 5 is internally formed with a bypass flow passage 15 connecting the pump hydraulic line 8P and the tank hydraulic line 8T while bypassing the direction control valve 3, wherein the meter-in flow adjustment valve 9 is disposed in the bypass flow passage 15. The meter-in flow adjustment valve 9 receives respective inputs of a primary pressure thereof, i.e., a pressure on an upstream side of the meter-in orifice 31 or the meter-in orifice 32, and the higher pressure selected by the shuttle valve 7, i.e., a pressure on a downstream side of the meter-in orifice 31 or the meter-in orifice 32, and is opened at an opening degree which gradually increases with an increase in difference between the two pressures, i.e., pressure difference across the meter-in orifice 31 or the meter-in orifice 32 (i.e., opened so as to increase the bleed-off flow rate via the bypass flow passage 15), thereby indirectly adjusting the meter-in flow rate via the meter-in orifice 31 or the meter-in orifice 32 to a flow rate corresponding to the stroke of the direction control valve 3, irrespective of a level of a load on the hydraulic motor 4.

The shuttle valve 7, provided to allow the meter-in flow adjustment valve 9 to function both during the lowing driving and during the lifting driving, is not essential for the present invention. For example, in the case of using the meter-in flow adjustment valve 9 only during the lowing driving, the pressure in the first motor hydraulic line 81M may be input into the meter-in flow adjustment valve 9 directly with no use of the shuttle valve 7.

The remote control valve 6 constitutes a manipulation device, in cooperation with a pilot hydraulic pressure source not graphically shown. The remote control valve 6 is interposed between the pilot hydraulic pressure source and each of the two pilot ports 3*a*, 3*b* of the direction control valve 3. The remote control valve 6 includes a manipulation lever 6*a* to be manipulated by an operator and a main valve unit 6*b* coupled to the manipulation lever 6*a*. The main valve unit 6*b* has a port for lowing driving and a port for lifting driving, and these ports are connected to the lowering pilot port 3*a* and the lifting pilot port 3*b* of the direction control valve 3 through a lowering pilot line 11*a* and a lifting pilot line 11*b*, respectively. The main valve unit 6*b* is interlocked with the manipulation lever 6*a* so as to output a pilot pressure at a level corresponding to the manipulation amount of the manipulation lever 6*a* from one of the output ports corresponding to the manipulation direction of the manipulation lever 6*a* and input the pilot pressure into one selected port of the pilot ports 3*a*, 3*b* of the direction control valve 3, the selected port corresponding to the output port.

Since the stroke of the direction control valve 3 from the neutral position P0 toward the lowering driving position P1 or the lifting driving position P2 is increased corresponding to the level of the pilot pressure to be input into the direction control valve 3, as described above, an operator can change the manipulation direction and stroke of the direction control valve 3 by manipulating the manipulation lever 6*a*, thereby changing the opening area of each of the orifices 30, 31 and 32. Thus, the meter-in orifice 31 included in the direction control valve 3 at the lowering driving position P1 thereof and the meter-in flow adjustment valve 9 constitute the meter-in flow adjuster for adjusting the meter-in flow rate during the lowering driving mode to a flow rate corresponding to a speed designated by the manipulation of the manipulation lever 6*a*.

The meter-out flow adjuster 10 includes a pilot-operated variable orifice valve 12 and a meter-out flow adjustment valve 14. The variable orifice valve 12 includes an orifice (meter-out orifice) having a variable opening area and a spring 12*a* elastically holding the orifice in a closed position. On the other hand, a flow adjusting pilot line 11*c* is branched off from the lowering pilot line 11*a* to introduce a lowering remote control pressure (pilot pressure) output from the remote control valve 6 to the variable orifice valve 12 as a pilot pressure in a direction of increasing the opening area of the orifice against a spring force of the spring 12*a*. The opening area of the orifice (meter-out orifice) in the variable orifice valve 12 is thus adjusted to a value corresponding to the manipulation amount of the manipulation lever 6*a* in the remote control valve 6.

The meter-out flow adjustment valve 14 includes a valve body and a spring 14*a* biasing the valve body in a valve opening direction. The meter-out flow adjustment valve 14 receives an input of a pressure on a downstream side of the variable orifice valve 12 to operate the valve body in the valve opening direction and an input of a pressure on an upstream side of the variable orifice valve 12 to operate the valve body in a valve closing direction against the spring 14*a*. The meter-out flow adjustment valve 14 is thus operated to keep a difference between the two pressures, i.e., a pressure difference across the variable orifice valve 12, at a constant pressure corresponding to a spring force of the spring 14*a*. The meter-out flow adjustment valve 14 may be located downstream of the variable orifice valve 12 as shown in FIG. 1, or may be located upstream thereof.

Figure 3:
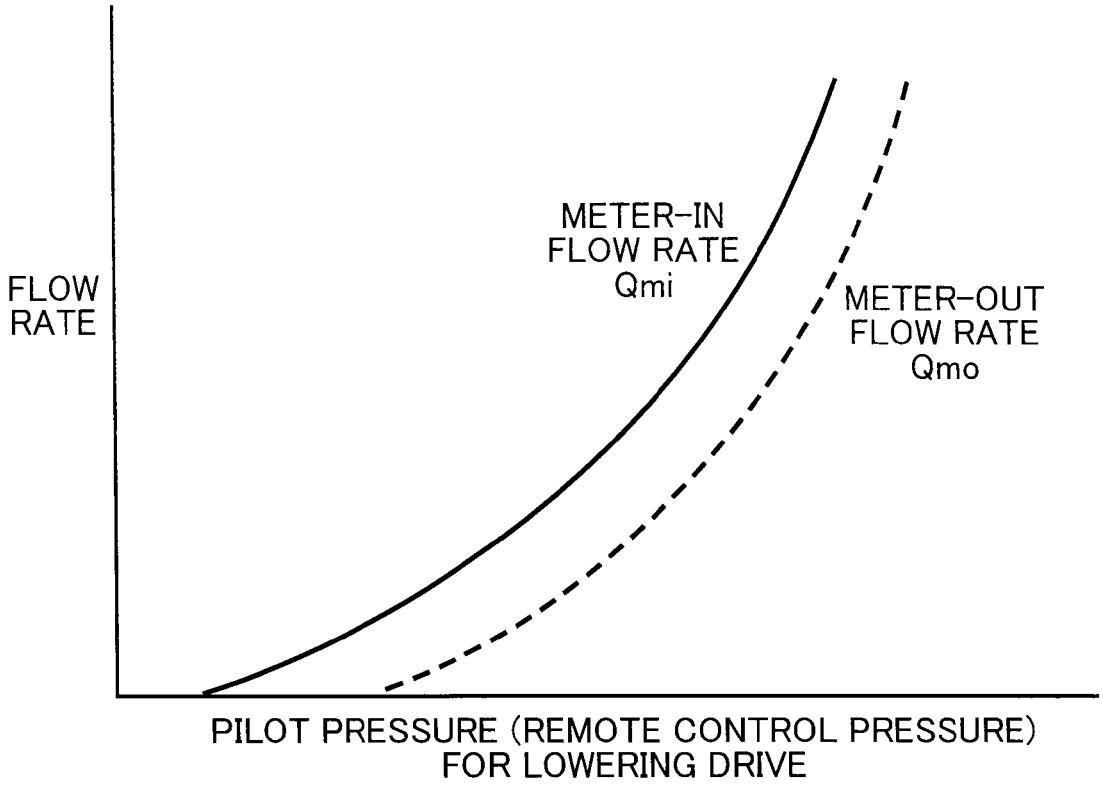
FIG. 3 is a graph showing a flow adjustment characteristic of a meter-in flow adjuster and a meter-out flow adjuster of the apparatus shown in FIG. 1 with respect to a remote control pressure.

FIG. 3 shows respective characteristics of the adjusted flow rates (respective controlled values of the meter-in flow rate and the meter-out flow rate) Qmi and Qmo by the meter-in flow adjuster (the meter-in orifice 31 of the control valve 5 and the meter-in flow adjustment valve 9) and the meter-out flow adjuster 10, with respect to remote control pressure, the characteristics indicated by the solid line and the dashed line, respectively. As shown in FIG. 3, the meter-in flow adjuster and the meter-out flow adjuster have such flow adjustment characteristics that the meter-in flow rate adjusted by the meter-in flow adjuster according to any value of the speed designated by the manipulation device is greater than a meter-out flow rate adjusted by the meter-out flow adjuster. In summary, each of the adjusters has a characteristic indicative of a relationship between the speed designated by the manipulation device and a flow rate to be adjusted according to the designated speed, the characteristics making the meter-out flow rate be less than the meter-in flow rate at any time.

The switch valve 18 is designed to open and close the second motor hydraulic line 82M at a position downstream of the meter-out flow adjuster 10, i.e., at a position between the meter-out flow adjuster 10 and the control valve 5, and composed of a pilot-operated selector valve. Specifically, the switch valve 18 includes a valve body and a spring 18*a* biasing the valve body in a valve closing direction and receives a pressure in the first motor hydraulic line 81M, that is, a pressure in the meter-in flow passage, as a pilot pressure to operate the valve body in a valve opening direction against a spring force of the spring 18*a*. The switch valve 18 has a setting pressure based on the spring force of the spring 18*a*, the setting pressure being set to a value enough to open the switch valve 18 in a relatively early phase following the start of the lowering driving, as described later.

The relief valve 16 is provided in the relief hydraulic line 86 and opened, when the meter-in pressure (specifically, a pressure in the first motor hydraulic line 81M forming the meter-in flow passage during the lowering driving) becomes equal to or greater than a setting pressure thereof, to introduce the hydraulic fluid flowed through the meter-in flow passage into the tank, thereby defining an upper limit of the meter-in pressure. While the setting pressure of the relief valve 16 is required to be set up to a flow rate greater than the pilot pressure of the switch valve 18, it is preferable, for reducing a load on the hydraulic pump 2, to set up the setting pressure as low as possible. In the case of omitting the switch valve 18 as described later, the setting pressure of the relief valve 16 only has to be set in such a range that the pressure difference across the hydraulic motor 4 is secured enough to drive the hydraulic motor 4 in the lowering driving direction under no-load conditions.

The third motor hydraulic line 83M is a pipeline to form a meter-in flow passage during the lifting driving, provided with a check valve 13 therein. The check valve 13 limits a flow direction of the hydraulic fluid in the third motor hydraulic line 83M to a direction from the control valve 5 toward the second port 4*b* of the hydraulic motor 4. In other words, the check valve 13 blocks a flow of the hydraulic fluid directed from the second port 4*b* toward the control valve 5.

The meter-out flow adjuster 10 can be provided between the control valve 5 and the tank, instead of between the second port 4*b* of the hydraulic motor 4 and the control valve 5. This case permits the third motor hydraulic line 83M and the switch valve 18 to be omitted. However, the arrangement including the third motor hydraulic line 83M and the switch valve 18 as shown in FIG. 1 has an advantage of enabling the hydraulic pipeline between the meter-out flow adjuster 10 and the second port 4*b* to be shortened and thereby reducing a possibility of stall of the hydraulic motor 4 due to damage of the hydraulic line.

Next will be described an operation of the apparatus according to the first embodiment.

Upon the manipulation of the manipulation lever 6*a* of the remote control valve 6 in a direction for lifting driving, the remote control pressure output from the remote control valve 6 is input into the lifting pilot port 3*b* of the direction control valve 3, thereby operating the direction control valve 3 from the neutral position P0 to the lifting driving position P2. At this time, there is no rise in a pressure in the first motor hydraulic line 81M and the switch valve 18 is thus kept in a closed state, so that the hydraulic fluid discharged from the hydraulic pump 2 is supplied to the third motor hydraulic line 83M and introduced into the second port 4*b* of the hydraulic motor 4 while opening the check valve 13, thus rotating the hydraulic motor 4 in the lifting direction. The hydraulic fluid discharged from the first port 4*a* of the hydraulic motor 4 is returned to the tank through the first motor hydraulic line 81M and the tank hydraulic line 8T.

On the other hand, upon the manipulation of the manipulation lever 6*a* of the remote control valve 6 in a direction for the lowering driving, the direction control valve 3 is operated to be opened from the neutral position P0 to the lowering driving position P1 according to the manipulation. Specifically, the remote control valve 6 outputs a pilot pressure at a level corresponding to the manipulation amount of the manipulation lever 6*a* to the direction control valve 3 through the lowering pilot line 11*a* to thereby operate the direction control valve 3 toward the lowering driving position P1 by a stroke corresponding to the pilot pressure. Along with this operation, the opening area of the bleed-off orifice of the direction control valve 3 is reduced to zero, while the opening area of the meter-in orifice 31 of the direction control valve 3 is increased to reduce the pressure difference across the meter-in orifice 31. Thus, the meter-in flow adjustment valve 9 is operated to close the bypass flow passage 15 which is the bleed-off flow passage to increase the meter-in flow rate Qmi, that is, to adjust the meter-in flow rate Qmi to a flow rate corresponding to the manipulation amount of the manipulation lever 6*a* irrespective of a level of a load. The hydraulic motor 4 is thereby rotated in the lowering direction, discharging hydraulic fluid from the second port 4*b*. More specifically, the meter-in flow adjustment valve 9 is operated to be opened so as to adjust the pressure difference across the meter-in orifice 31 to a predetermined value, thereby controlling the meter-in flow rate Qmi to a flow rate corresponding to the opening area of the meter-in orifice 31, i.e., a flow rate corresponding to a speed designated by the manipulation of the manipulation lever 6*a*.

Accompanying the start of the lowering driving, the pressure in the first motor hydraulic line 81M, i.e., the pilot pressure of the switch valve 18 is raised to open the switch valve 18, that is, open up the second motor hydraulic line 82M to form the meter-out flow passage. Hence, the hydraulic fluid discharged from the second port 4*b* of the hydraulic motor 4 is returned to the tank through the meter-out flow passage, specifically, while passing through the meter-out flow adjuster 10 and the switch valve 18 in this order. Herein, the relief valve 16 defines the upper limit of the pressure in the meter-in flow passage to the setting pressure of the relief valve 16, while the setting pressure of the relief valve 16 is set to a value greater than the pilot pressure of the switch valve 18; thus, the open state of the switch valve 18 is guaranteed.

The opening area of the orifice (meter-out orifice) of the variable orifice valve 12 of the meter-out flow adjuster 10 in the second motor hydraulic line 82M thus opened is varied according to the manipulation amount of the manipulation lever 6*a*, and the meter-out flow adjustment valve 14 controls the meter-out flow rate Qmo to a flow rate corresponding to the manipulation amount. Specifically, the meter-out flow adjustment valve 14 is operated to be opened so as to bring the pressure difference across the meter-out orifice of the variable orifice valve 12 into agreement with a predetermined value, thereby controlling the meter-out flow rate to a flow rate corresponding to the opening area of the meter-out orifice, i.e., a flow rate corresponding to a speed designated by the manipulation of the manipulation lever 6*a*.

While the meter-out flow rate Qmo is thus controlled, lowering driving is carried out at a speed corresponding to the manipulation amount of the manipulation lever 6, irrespective of a level of a load (in this embodiment, a suspended load). In other words, the meter-out flow adjuster 10 controls the meter-out flow rate according to the manipulation amount of the manipulation lever 6*a*, irrespective of a variation in weight of a suspended load as the load. Hence, differently from the conventional technique, it is possible to effectively suppress a change in speed of the actuator due to an increase/decrease in weight of the load to contribute to improved operability and safety.

Furthermore, in this apparatus, in addition to the meter-out flow rate Qmo, the meter-in flow rate Qmi is also controlled to a flow rate corresponding to the manipulation amount of the manipulation lever 6*a* by the meter-in flow adjuster (the meter-in orifice 31 and the meter-in flow adjustment valve 9), and respective flow adjustment characteristics of the meter-in and meter-out flow adjusters (respective characteristics of flow rates to be adjusted according to the manipulation amount of the manipulation lever 6*a*) are set such that the controlled meter-in flow rate Qmi is greater than the meter-out flow rate Qmo at any time: this prevents the meter-in pressure from excessive decrease due to an excess of the meter-out flow rate over the meter-in flow rate, thereby preventing cavitation from occurring on the meter-in side due to the above excessive decrease.

Besides, since the prevention of the cavitation is achieved by a combination of the meter-in flow adjuster and the meter-out flow adjuster, as mentioned above, there is no need for use of a counterbalance valve as in the conventional technique; therefore, the cavitation can be prevented without a disadvantage involved by the use of the counterbalance valve, that is, a disadvantage of occurrence of hunting of the meter-in pressure, or occurrence of response lag or large boosted pressure due to using an orifice for preventing the hunting.

On the other hand, since the meter-in pressure is kept equal to or less than the setting pressure by the relief valve 16 which is opened when the meter-in pressure reaches a predetermined setting pressure thereof, an excessive increase in driving power for the hydraulic pump and deterioration in fuel economy due to an unnecessary increase in the meter-in pressure can be avoided.

Next will be described a hydraulic driving apparatus according to a second embodiment of the present invention with reference to FIGS. 4 and 5.

Figure 4:
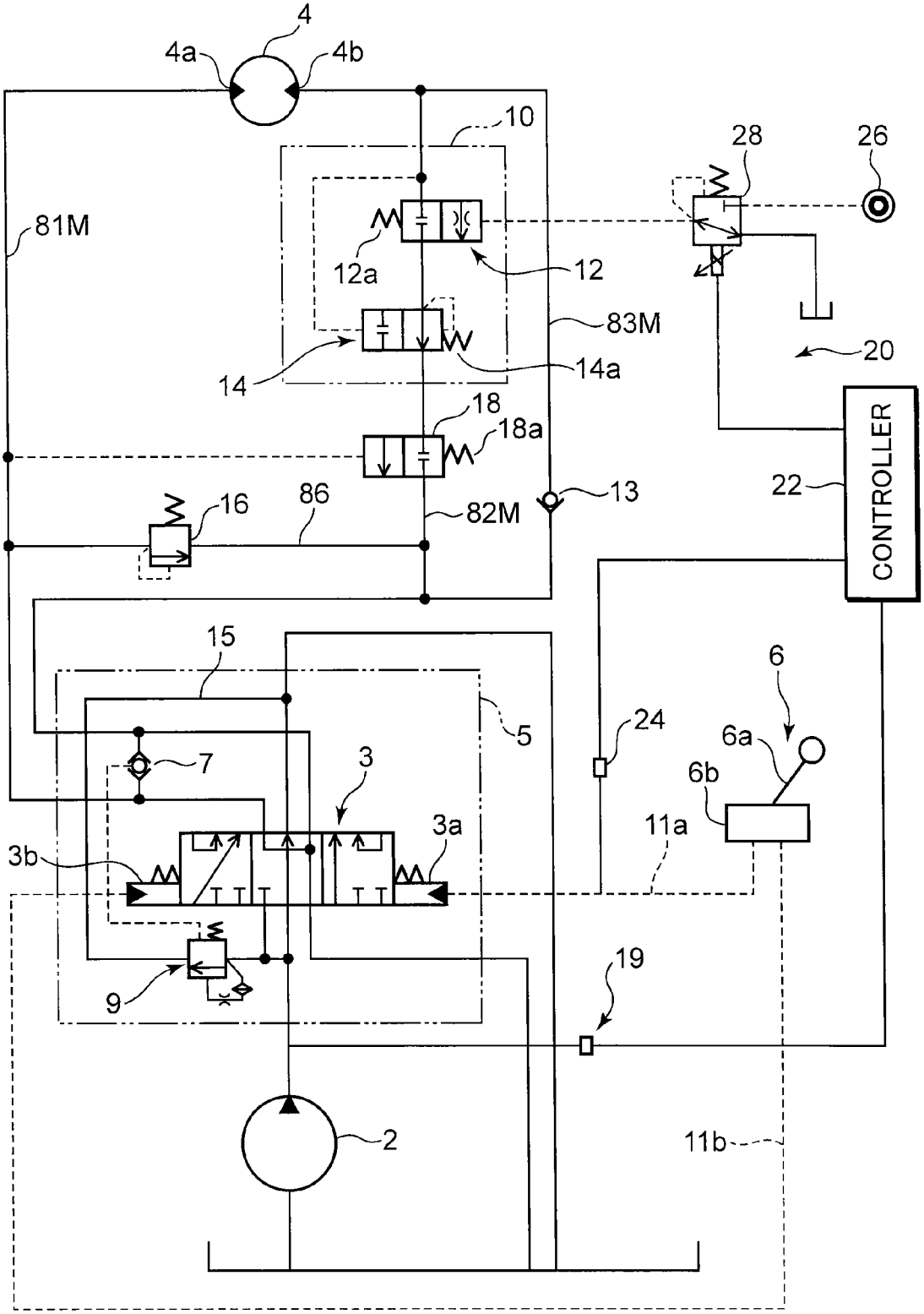
FIG. 4 is a circuit diagram showing a hydraulic driving apparatus for a working machine, the apparatus according to a second embodiment of the present invention.

In addition to a configuration equivalent to the fundamental configuration of the apparatus shown in FIG. 1, the apparatus shown in FIG. 4 further comprises a discharge-flow-rate detection device 19 for detecting a discharge flow rate of the hydraulic pump 2 (or a value equivalent thereto) and a meter-out-flow-rate restricting section 20 for restricting a meter-out flow rate based on a result of the detection. The meter-out-flow-rate restricting section 20 restricts an actual meter-out flow rate under a flow rate to which the meter-out flow adjuster 10 is required to adjust the actual meter-out actual flow rate according to a speed designated by the manipulation device of the remote control valve 6 (according to the remote control pressure), when the discharge flow rate detected by the discharge-flow-rate detection device 19 is less than a required meter-in flow rate to which the meter-in flow adjuster is required to adjust the actual meter-in flow rate according to a speed designated by manipulation of the remote control valve 6 as the manipulation device (i.e., according to a remote control pressure), i.e., when there is a possibility of saturation of the meter-in flow rate due to deficiency in the discharge flow rate, in such a manner as to keep the meter-out flow below the meter-in flow in spite of the saturation.

Figure 5:
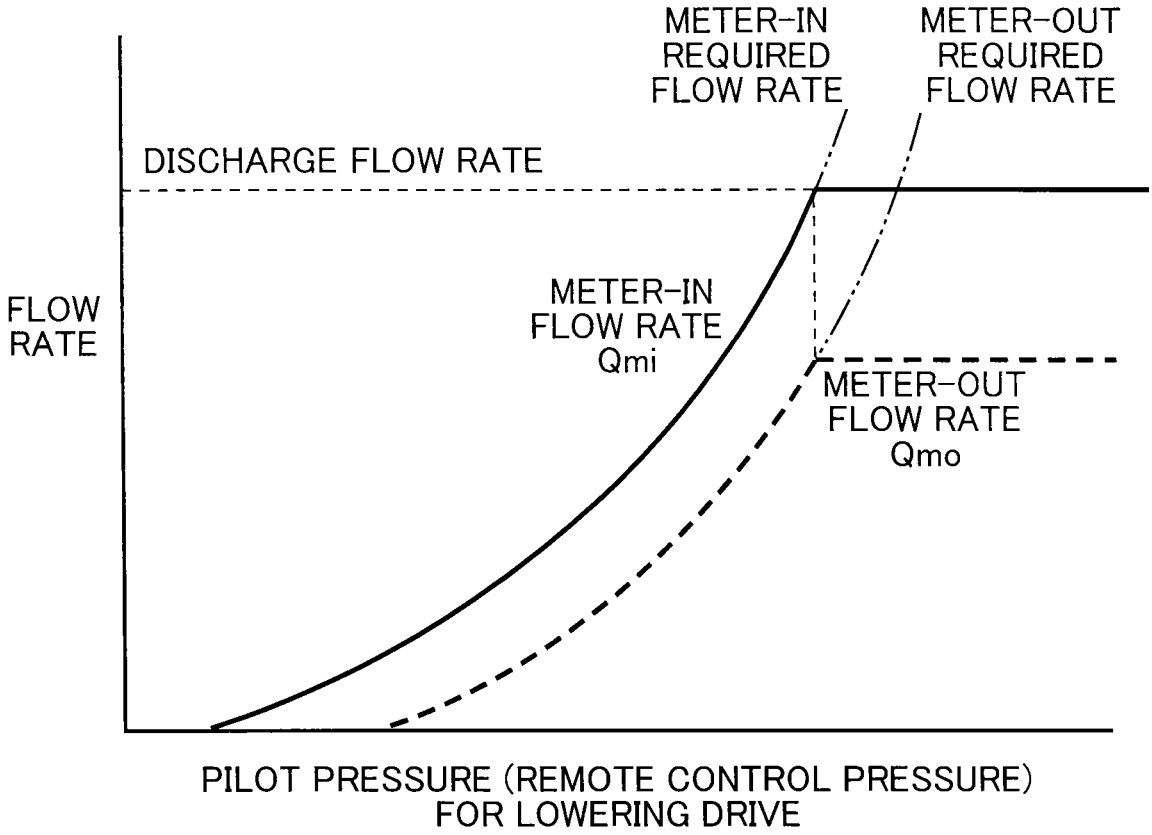
FIG. 5 is a graph showing a flow adjustment characteristic of a meter-in flow adjuster and a meter-out flow adjuster of the apparatus shown in FIG. 4 with respect to a remote control pressure.

FIG. 5 shows the saturation which is possible to occur in the meter-in flow rate. In the first embodiment, as shown in FIG. 3, respective flow adjustment characteristics of the meter-in flow adjuster and the meter-out flow adjuster 10 is set such that both of the meter-in flow rate Qmi and the meter-out flow rate Qmo are increased with an increase in the remote control pressure which is a pilot pressure for the lifting driving, and the relationship of Qmi>Qmo is maintained, whereas an actual meter-in flow rate Qmi is not permitted to be greater than the discharge flow rate of the hydraulic pump 2; therefore, in the case of low discharge flow rate, the meter-in flow rate Qmi will max out at the discharge flow rate regardless of an increase in the remote control pressure, as shown in FIG. 5. Thus saturated meter-in flow rate Qmi is possible to reverse the magnitude relation in Qmi>Qmo, causing a problem of stall of the hydraulic motor 4 or the like. For the reason, the meter-out-flow-rate restricting section 20 in the second embodiment is designed to restrict an actual meter-out flow rate adjusted by the meter-out flow adjuster 10 under the required meter-out flow rate corresponding to the speed designated by the manipulation of the remote control valve 6, in the situation where there is a possibility of occurrence of the above saturation, thereby maintaining the magnitude relation in Qmi>Qmo.

Specifically, while the remote control pressure output from the remote control valve 6 is, in the first embodiment, directly input into the variable orifice valve 12 of the meter-out flow adjuster 10 as a pilot pressure, the meter-out-flow-rate restricting section 20 in the second embodiment performs the restriction of the meter-out flow rate by converting the remote control pressure into an electric signal to electrically control the pilot pressure of the variable orifice valve 12.

More specifically, the meter-out-flow-rate restricting section 20 includes: a pilot pressure sensor 24 for detecting a pilot pressure for the lowering driving (remote control pressure), a controller 22 for performing the meter-out flow rate restriction control based on a detection signal of the pilot pressure sensor 24, a pilot pressure source 26 for the meter-out flow rate restriction control, and an electromagnetic proportional pressure reducing valve 28 interposed between the pilot pressure source 26 and the variable orifice valve 12. The electromagnetic proportional pressure reducing valve 28 includes a solenoid and outputs a secondary pressure corresponding to an instruction signal input into the solenoid, as a pilot pressure of the variable orifice valve 12. The pilot pressure source for the electromagnetic proportional pressure reducing valve 28 can be also used as a pilot pressure source for the remote control valve 6. Specifically, the electromagnetic proportional pressure reducing valve 28 can be also interposed between the remote control valve 6 and the variable orifice valve 12.

The controller 22 outputs an instruction signal to the electromagnetic proportional pressure reducing valve 28, thereby operating a second pressure thereof, i.e., a pilot pressure to be input into the variable orifice valve 12. Specifically, the controller 22 calculates a required meter-in flow rate and a required meter-out flow rate each corresponding to the manipulation amount of the manipulation lever 6*a* in the remote control valve 6, based on a detection signal of the pilot pressure sensor 24, and inputs an instruction signal, based on the calculated required meter-in flow rate, into the electromagnetic proportional pressure reducing valve 28 as follows: when the calculated required meter-in flow rate is equal to or less than a discharge flow rate of the hydraulic pump 2 detected by the discharge-flow-rate detection device 19, the controller 22 inputs, into the electromagnetic proportional pressure reducing valve 28, an instruction signal for instructing the meter-out flow adjuster 10 to adjust an actual meter-out flow rate to the required meter-out flow rate, i.e., an instruction signal for bringing an actual meter-out flow rate Qmo into agreement with the required meter-out flow rate; when the calculated required meter-in flow rate is greater than the discharge flow rate, i.e., when there is a possibility of occurrence of saturation in the meter-in flow rate Qmi as shown in FIG. 5, the controller 22 inputs, into the electromagnetic proportional pressure reducing valve 28, an instruction signal for restricting the meter-out flow rate Qmo under the required meter-out flow rate as shown in FIG. 5, specifically, an instruction signal for restricting the meter-out flow rate Qmo so as to maintain the relation that the meter-out flow rate Qmo is less than the meter-in flow rate Qmi, irrespective of the saturation, as shown in FIG. 5.

The judgment on whether the meter-out flow rate restriction should be performed or not may be made based on a comparison between the discharge flow rate and the required meter-out flow rate, instead of the above direct comparison between the discharge flow rate and the required meter-in flow rate. For example, there may be made a judgment of performing the meter-out flow rate restriction, when the required meter-out flow rate is equal to a predetermined value set around the discharge flow rate (e.g., a value of 90% of the discharge flow rate). In other words, the criterion for judgment on whether restricting the meter-out flow rate or not may be appropriately determined under a condition that the meter-out flow rate can be restricted so as to prevent the reversal in the magnitude relation of the meter-in flow rate and the meter-out flow rate due to the saturation in the meter-in flow rate.

The hydraulic actuator according to the present invention is not limited to the hydraulic motor but may be, for example, a hydraulic cylinder for raising and lowering an attachment of a working apparatus. Also in this case, the present invention can be effectively applied for driving the attachment in a lowering direction equal to a self-weight falling direction thereof. Alternatively, the hydraulic actuator may be a variable displacement motor.

As mentioned above, according to the present invention, provided is a hydraulic driving apparatus for a working machine, the apparatus being capable of preventing pressure on a meter-in side from an excessive decrease and moving a load at a stable speed in a lowering direction, which is the same direction as a self-weight falling direction of the load, with no occurrence of hunting and large boosted pressure, which are disadvantage of the conventional counterbalance valve. The provided hydraulic driving apparatus comprises: a hydraulic pump for discharging hydraulic fluid; a hydraulic actuator having a first port and a second port and being adapted to be driven, by receiving a supply of hydraulic fluid discharged from the hydraulic pump through the first port and discharging the hydraulic fluid from the second port, so as to move the load in the lowering direction; a manipulation device manipulated to designate an operating speed of the hydraulic actuator; a working hydraulic circuit including a meter-in flow passage for introducing hydraulic fluid from the hydraulic pump into the first port of the hydraulic actuator when the hydraulic actuator is driven to move the load in the lowering direction and a meter-out flow passage for introducing hydraulic fluid discharged from the second port of the hydraulic actuator into a tank when the hydraulic actuator is driven to move the load in the lowering direction; a control valve for changing a state of the supply of hydraulic fluid from the hydraulic pump to the hydraulic actuator so as to operate the hydraulic actuator at the speed designated by the manipulation device; a meter-in flow adjuster for adjusting a meter-in flow rate, which is a flow rate of the hydraulic fluid in the meter-in flow passage, to a flow rate corresponding to the speed designated by the manipulation device; a meter-out flow adjuster for adjusting a meter-out flow rate, which is a flow rate of the hydraulic fluid in the meter-out flow passage, to a flow rate corresponding to the speed designated by the manipulation device; and a relief valve adapted to be opened, when a pressure of the meter-in flow passage becomes equal to or greater than a setting pressure, so as to introduce hydraulic fluid flowing through the meter-in flow passage into the tank to thereby define an upper limit of the pressure of the meter-in flow passage. Furthermore, the meter-in flow adjuster and the meter-out flow adjuster have respective flow adjustment characteristics, each of which is a characteristic indicative of a relationship between the speed designated by the manipulation device and a flow rate to be adjusted according to the designated speed, such that the meter-in flow rate adjusted by the meter-in flow adjuster according to any value of the speed designated by the manipulation device is greater than a meter-out flow rate adjusted by the meter-out flow adjuster.

In the hydraulic driving apparatus of the present invention, the meter-out flow adjuster provided in the meter-out flow passage adjusts the meter-out flow rate to a flow rate corresponding to the designated speed, thereby keeping a lowering speed of a load at a value corresponding to the manipulation of the manipulation device, irrespective of a level of the load to enable high operability and safety. In addition, the meter-in flow adjuster and the meter-out flow adjuster have respective flow adjustment characteristics such that a meter-out flow rate adjusted by the meter-out flow adjuster according to any value of the speed designated by the manipulation device is less than a meter-in flow rate adjusted by the meter-in flow adjuster according to the speed value; therefore, the occurrence of an excessive decrease in pressure of a meter-in pressure, that is, pressure in the meter-in flow passage, due to an excess of the meter-out flow rate over the meter-in flow rate, is prevented, and thus the cavitation is prevented from occurrence due to the decrease in the meter-in pressure. Besides, there is no need for a counterbalance valve to prevent the cavitation, and therefore there is no occurrence of disadvantage arising from the counterbalance valve, i.e., disadvantage of occurrence of hunting of the meter-in pressure or occurrence of response lag or boosted pressure due to use of an orifice for preventing the hunting.

As the meter-in flow adjuster, preferable is one which includes a meter-in orifice having a flow passage area variable according to the manipulation of the manipulation device, and a meter-in flow adjustment valve which varies the meter-in flow rate to bring a pressure difference across the meter-in orifice into agreement with a predetermined value. Similarly, as the meter-out flow adjuster, preferable is one which includes a meter-out orifice having a flow passage area variable according to the manipulation of the manipulation device and a meter-out flow adjustment valve which varies the meter-out flow rate to bring a pressure difference across the meter-out orifice into agreement with a predetermined value. The combination of the orifice and the flow adjustment valve in each of the flow adjusters makes it possible to keep a lowering speed of a load at a value corresponding to the manipulation of the manipulation device, with a simple configuration.

In the present invention, it is preferable to use, as the hydraulic actuator, a type operable in both forward and reverse directions, more specifically, a type of being driven so as to move the load in the lowering direction, by receiving a supply of hydraulic fluid through the first port while discharging the hydraulic fluid from the second port, and being driven so as to move the load in the lifting direction, by receiving a supply of hydraulic fluid through the second port while discharging the hydraulic fluid from the first port, to move a load not only in a lowering direction but also in a lifting direction. For this purpose, it is preferable that: the control valve includes a pilot-operated selector valve having a neutral position for hindering hydraulic fluid discharged from the hydraulic pump from being supplied to the hydraulic actuator, a lowering driving position for leading hydraulic fluid discharged from the hydraulic pump to the first port of the hydraulic actuator through the meter-in flow passage and returning hydraulic fluid discharged from the second port of the hydraulic actuator to the tank through the meter-out flow passage, and a lifting driving position for forming a flow passage for leading hydraulic fluid discharged from the hydraulic pump to the second port of the hydraulic actuator and a flow passage for returning hydraulic fluid discharged from the first port of the hydraulic actuator to the tank, the pilot-operated selector valve being provided with respective pilot ports corresponding to the lowering driving position and the lifting driving position and operated from the neutral position in a direction corresponding to the pilot port which receives input of a pilot pressure, by a stroke corresponding to a level of the pilot pressure; and the manipulation device includes a remote-control valve interposed between a pilot hydraulic pressure source and each of the pilot ports and adapted to supply a pilot pressure corresponding to the manipulation of the remote-control valve to the pilot port corresponding to the manipulation. In the case, the meter-in orifice and/or the meter-out orifice can be readily controlled according to the content of the manipulation of the manipulation device by utilization of the pilot pressure. Specifically, the meter-in flow adjuster preferably comprises a meter-in orifice valve receiving the supply of the pilot pressure and including the meter-in orifice, the meter-in orifice valve having an opening area variable according to a level of the pilot pressure. Besides, the meter-out flow adjuster preferably comprises a meter-out orifice valve receiving the supply of the pilot pressure and including the meter-out orifice, the meter-out orifice having an opening area variable according to a level of the pilot pressure.

Moreover, in this case, using the pilot-operated selector valve also as at least one of the meter-in orifice and the meter-out orifice enables the configuration of the apparatus to be simplified. Specifically, it is preferable that the pilot-operated selector valve is a direction and flow rate control valve including at least one of the meter-in orifice and the meter-out orifice, the orifice having an opening area variable to increase with a stroke from the neutral position.

Besides, it is also preferable that the hydraulic driving apparatus further comprises: a discharge-flow-rate detection device for detecting a discharge flow rate of the hydraulic pump or a value equivalent thereto; and a meter-out-flow-rate restricting section which restricts a meter-out flow rate adjusted by the meter-out flow adjuster under a flow rate to which the meter-out flow adjuster is required to adjust the meter-out flow rate according to the speed designated by the manipulation of the manipulation device, when a discharge flow rate detected by the discharge-flow-rate detection device is less than a flow rate to which the meter-in flow adjuster is required to adjust the meter-in flow rate according to the speed designated by the manipulation of the manipulation device, so as to keep the meter-out flow rate adjusted by the meter-out flow adjuster at a flow rate less than the discharge flow rate detected by discharge-flow-rate detection device.

According to the apparatus, in a situation where the meter-in flow rate cannot reach a required meter-in flow rate corresponding to the speed designated by the manipulation of the manipulation device, i.e., in a situation where there is a possibility of occurrence of saturation in the meter-in flow rate adjusted by the meter-in flow adjuster due to deficiency in the discharge flow rate, the above meter-out-flow-rate restricting section can maintain the magnitude correlation of actual meter-in and meter out flow rates, irrespective of the saturation, by restricting the meter-out flow rate adjusted by the meter-out flow adjuster under the required meter-out flow rate corresponding to the speed designated by the manipulation of the manipulation device. In summary, even if the discharge flow rate is low, the relation that the meter-out flow rate is less than the meter-in flow rate can be maintained, which allows a problem arising from reversal in the magnitude relation of the two flow rates, such as stall of the hydraulic actuator, to be prevented from occurrence.

In the present invention, it is preferable that the distance between the second port of the hydraulic actuator and the meter-out flow adjuster is set as short as possible. While damage in a hydraulic line between the second port and the meter-out flow adjuster may involve stall of the hydraulic actuator, the risk of the stall is low as the distance between the second port and the meter-out flow adjuster is shorten.

In this regard, in the case where the control valve includes a direction control valve having a neutral position for hindering hydraulic fluid discharged from the hydraulic motor from being supplied to the hydraulic actuator, a lowering driving position for forming a flow passage for leading hydraulic fluid discharged from the hydraulic pump to the first port of the hydraulic actuator through the meter-in flow passage and returning hydraulic fluid discharged from the second port of the hydraulic actuator to the tank via the meter-out flow passage, and a lifting driving position for forming a flow passage for leading hydraulic fluid discharged from the hydraulic pump to the second port of the hydraulic actuator and a flow passage for returning hydraulic fluid discharged from the first port of the hydraulic actuator to the tank, it is effective to provide the meter-out flow adjuster between the second port and the direction control valve, as mentioned above, in view of reducing a possibility of stall of the hydraulic actuator due to damage of the hydraulic line, while the meter-out flow adjuster may be provided between the direction control valve and the tank.

For realizing both the lowering driving and lifting driving while allowing the meter-out flow adjuster to be located between the second port and the direction control valve, it is preferable that: a first actuator hydraulic line is provided between the direction control valve and the first port of the hydraulic actuator to form the meter-in flow passage during a lowering driving and form the meter-out flow passage during a lifting driving; a second actuator hydraulic line for introducing hydraulic fluid from the second port to the direction control valve during the lowering driving and a third actuator hydraulic line for introducing hydraulic fluid from the direction control valve to the second port during the lifting driving are provided between the direction control valve and the second port of the hydraulic actuator, in a mutual parallel arrangement; the third actuator hydraulic line is provided with a check valve for blocking a flow of hydraulic fluid in a direction from the hydraulic actuator to the direction control valve; the second actuator hydraulic line is provided with the meter-out flow adjuster and a pilot-operated switch valve located between the meter-out flow adjuster and the direction control valve and adapted to open the second actuator hydraulic line only when a pressure of the hydraulic fluid in the first actuator hydraulic line is equal to or greater than a predetermined setting pressure; and the setting pressure of the pilot-operated switch valve is set to a value less than the setting pressure of the relief valve.

In this apparatus, during the lifting driving in which the direction control valve is shifted to the lifting driving position, the pilot pressure for the pilot-operated switch valve is not raised and the switch valve closes the second actuator hydraulic line, so that the hydraulic fluid discharged from the hydraulic pump is supplied to the second port of the hydraulic actuator via the direction control valve and the third actuator hydraulic line. On the other hand, during the lowering driving in which the direction control valve is shifted to the lowering driving position, the switch valve is operated to open the second actuator hydraulic line when a pressure of hydraulic fluid in the first actuator hydraulic line forming the meter-in flow passage is increased to the pilot pressure of the pilot-operated switch valve, thereby allowing the hydraulic fluid from the second port to be returned to the tank via the second actuator hydraulic line and allowing the meter-out flow rate to be adjusted by the meter-out flow adjuster provided in the second actuator line. Besides, setting the setting pressure of the relief valve to a value greater than the setting pressure of the switch valve allows the opening operation of the switch valve to be secured.

This application is based on Japanese Patent application No. 2011-275726 filed in Japan Patent Office on Dec. 16, 2011, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A hydraulic driving apparatus for a working machine, the hydraulic driving apparatus being designed to move a load in a lowering direction which is the same direction as a self-weight falling direction of the load by means of hydraulic pressure, the hydraulic driving apparatus comprising:

a hydraulic pump for discharging hydraulic fluid;

a hydraulic actuator having a first port and a second port, the hydraulic actuator being adapted to be driven so as to move the load in the lowering direction, by receiving a supply of hydraulic fluid discharged from the hydraulic pump through the first port while discharging the hydraulic fluid from the second port;

a manipulation device adapted to be manipulated to designate an operating speed of the hydraulic actuator;

a working hydraulic circuit including a meter-in flow passage for introducing hydraulic fluid from the hydraulic pump into the first port of the hydraulic actuator when the hydraulic actuator is driven to move the load in the lowering direction and a meter-out flow passage for introducing hydraulic fluid discharged from the second port of the hydraulic actuator into a tank when the hydraulic actuator is driven to move the load in the lowering direction;

a control valve for changing a state of the supply of hydraulic fluid from the hydraulic pump to the hydraulic actuator so as to operate the hydraulic actuator at the speed designated by the manipulation device;

a meter-in flow adjuster for adjusting a meter-in flow rate, which is a flow rate of the hydraulic fluid in the meter-in flow passage, the meter-in flow adjuster having a first flow adjustment characteristic which is a characteristic indicative of a relationship between the speed designated by the manipulation device and a meter-in flow rate to be adjusted according to the designated speed, the meter-in flow adjuster being configured to adjust the meter-in flow rate to a flow rate corresponding to the speed designated by the manipulation device according to the first flow adjustment characteristic; the meter-in flow adjuster including a meter-in orifice having a flow passage area variable according to the manipulation of the manipulation device and a meter-in flow adjustment valve which receives an input of an upstream-side pressure on an upstream side of the meter-in orifice and an input of a downstream-side pressure on an downstream side of the meter-in orifice and varies the meter-in flow rate so as to bring a pressure difference between the upstream-side pressure and the downstream-side pressure of the meter-in orifice into agreement with a predetermined value;

a meter-out flow adjuster for adjusting a meter-out flow rate, which is a flow rate of the hydraulic fluid in the meter-out flow passage, the meter-out flow adjuster having a second flow adjustment characteristic which is a characteristic indicative of a relationship between the speed designated by the manipulation device and a meter-out flow rate to be adjusted according to the designated speed, the meter-out flow adjuster being configured to adjust the meter-out flow rate to a flow rate corresponding to the speed designated by the manipulation device according to the second flow adjustment characteristic, the meter-out flow adjuster including a meter-out orifice having a flow passage area variable according to the manipulation of the manipulation device and a meter-out flow adjustment valve which receives an input of an upstream-side pressure on an upstream side of the meter-out orifice and an input of a downstream-side pressure on an downstream side of the meter-out orifice and varies the meter-out flow rate so as to bring a pressure difference between the upstream-side pressure and the downstream-side pressure of the meter-out orifice into agreement with a predetermined value; and a relief valve adapted to be opened, when a pressure of the meter-in flow passage becomes equal to or greater than a setting pressure, so as to introduce hydraulic fluid flowing through the meter-in flow passage into the tank to thereby define an upper limit of the pressure of the meter-in flow passage;

wherein the first and second flow adjustment characteristics are set so as to make the meter-in flow rate adjusted by the meter-in flow adjuster based on the first flow adjustment characteristic be greater than the meter-out flow rate adjusted by the meter-out flow adjuster based on the second flow adjustment characteristic, with respect to any value of the speed designated by the manipulation device.

2. The hydraulic driving apparatus as defined in claim 1, which further comprises:

a discharge-flow-rate detection device for detecting a discharge flow rate of the hydraulic pump or a value equivalent thereto; and a meter-out-flow-rate restricting section which restricts a meter-out flow rate adjusted by the meter-out flow adjuster under a flow rate to which the meter-out flow adjuster is required to adjust the meter-out flow rate according to the speed designated by the manipulation of the manipulation device, when a discharge flow rate detected by the discharge-flow-rate detection device is less than a flow rate to which the meter-in flow adjuster is required to adjust the meter-in flow rate according to the speed designated by the manipulation of the manipulation device, so as to keep the meter-out flow rate adjusted by the meter-out flow adjuster at a flow rate less than the discharge flow rate detected by discharge-flow-rate detection device.

3. The hydraulic driving apparatus as defined in claim 1, wherein the control valve includes a pilot-operated selector valve having a neutral position for hindering hydraulic fluid discharged from the hydraulic pump from being supplied to the hydraulic actuator, a lowering driving position for leading hydraulic fluid discharged from the hydraulic pump to the first port of the hydraulic actuator through the meter-in flow passage and returning hydraulic fluid discharged from the second port of the hydraulic actuator to the tank through the meter-out flow passage, and a lifting driving position for forming a flow passage for leading hydraulic fluid discharged from the hydraulic pump to the second port of the hydraulic actuator and a flow passage for returning hydraulic fluid discharged from the first port of the hydraulic actuator to the tank, the pilot-operated selector valve being provided with respective pilot ports corresponding to the lowering driving position and the lifting driving position and operated from the neutral position in a direction corresponding to the pilot port which receives input of a pilot pressure, by a stroke corresponding to a level of the pilot pressure, and wherein: the manipulation device includes a remote-control valve adapted to supply a pilot pressure corresponding to the manipulation of the remote-control valve to the pilot port corresponding to the manipulation; and the meter-in flow adjuster comprises a meter-in orifice valve receiving the supply of the pilot pressure and including the meter-in orifice, the meter-in orifice valve having an opening area variable according to a level of the pilot pressure.

4. The hydraulic driving apparatus as defined in claim 3, wherein the pilot-operated selector valve is a direction and flow rate control valve including a meter-in orifice, the orifice having an opening area variable to increase with a stroke from the neutral position.

5. The hydraulic driving apparatus as defined in claim 1, wherein the control valve includes a pilot-operated selector valve having a neutral position for hindering hydraulic fluid discharged from the hydraulic pump from being supplied to the hydraulic actuator, a lowering driving position for leading hydraulic fluid discharged from the hydraulic pump to the first port of the hydraulic actuator through the meter-in flow passage and returning hydraulic fluid discharged from the second port of the hydraulic actuator to the tank through the meter-out flow passage, and a lifting driving position for forming a flow passage for leading hydraulic fluid discharged from the hydraulic pump to the second port of the hydraulic actuator and a flow passage for returning hydraulic fluid discharged from the first port of the hydraulic actuator to the tank, the pilot-operated selector valve being provided with respective pilot ports corresponding to the lowering driving position and the lifting driving position and operated from the neutral position in a direction corresponding to the pilot port which receives input of a pilot pressure, by a stroke corresponding to a level of the pilot pressure, and wherein: the manipulation device includes a remote-control valve adapted to supply a pilot pressure corresponding to the manipulation of the remote-control valve to the pilot port corresponding to the manipulation; and the meter-out flow adjuster comprises a meter-out orifice valve receiving the supply of the pilot pressure and including the meter-out orifice, the meter-out orifice valve having an opening area variable according to a level of the pilot pressure.

6. The hydraulic driving apparatus as defined in claim 1, wherein the control valve includes a pilot-operated selector valve having a neutral position for hindering hydraulic fluid discharged from the hydraulic pump from being supplied to the hydraulic actuator, a lowering driving position for leading hydraulic fluid discharged from the hydraulic pump to the first port of the hydraulic actuator through the meter-in flow passage and returning hydraulic fluid discharged from the second port of the hydraulic actuator to the tank through the meter-out flow passage, and a lifting driving position for forming a flow passage for leading hydraulic fluid discharged from the hydraulic pump to the second port of the hydraulic actuator and a flow passage for returning hydraulic fluid discharged from the first port of the hydraulic actuator to the tank, and wherein: a first actuator hydraulic line is provided between the direction control valve and the first port of the hydraulic actuator to form the meter-in flow passage during a lowering driving and to form the meter-out flow passage during a lifting driving; a second actuator hydraulic line for introducing hydraulic fluid from the second port to the direction control valve during the lowering driving and a third actuator hydraulic line for introducing hydraulic fluid from the direction control valve to the second port during the lifting driving are provided between the direction control valve and the second port of the hydraulic actuator, in a mutual parallel arrangement; the third actuator hydraulic line is provided with a check valve for blocking a flow of hydraulic fluid in a direction from the hydraulic actuator to the direction control valve; the second actuator hydraulic line is provided with the meter-out flow adjuster and a pilot-operated switch valve located between the meter-out flow adjuster and the direction control valve and adapted to open the second actuator hydraulic line only when a pressure of the hydraulic fluid in the first actuator hydraulic line is equal to or greater than a predetermined setting pressure; and the setting pressure of the pilot-operated switch valve is set to a value less than the setting pressure of the relief valve.

* * * * *